United States Patent [19]

Ohno et al.

[11] Patent Number: 4,717,313

[45] Date of Patent: Jan. 5, 1988

[54] SWASH PLATE TYPE COMPRESSOR WITH INTERNAL SEALING

[75] Inventors: Makoto Ohno; Hideo Mori; Toshihiko Nasu; Hideki Watanabe, all of Kariya, Japan

[73] Assignee: Kabushiki Kaisha Toyoda Jidoshokki Seisakusho, Aichi, Japan

[21] Appl. No.: 4,190

[22] Filed: Jan. 15, 1987

[30] Foreign Application Priority Data

Jan. 17, 1986 [JP] Japan ..... 61-005590[U]

[51] Int. Cl.[4] ..... F04B 27/08; F04B 39/10

[52] U.S. Cl. ..... 417/269; 417/571

[58] Field of Search ..... 417/269, 559, 571, 902; 92/71

[56] References Cited

U.S. PATENT DOCUMENTS

| | | | |
|---|---|---|---|
| 3,380,651 | 4/1968 | Niki et al. | 417/269 |
| 4,070,136 | 1/1978 | Nakayama et al. | 417/269 |
| 4,403,921 | 9/1983 | Kato et al. | 417/296 |
| 4,407,638 | 10/1983 | Sasaya et al. | 417/269 |

FOREIGN PATENT DOCUMENTS

| | | | |
|---|---|---|---|
| 56-27710 | 6/1981 | Japan | 417/269 |

*Primary Examiner*—Carlton R. Croyle
*Assistant Examiner*—Paul F. Neils
*Attorney, Agent, or Firm*—Burgess, Ryan & Wayne

[57] ABSTRACT

A swash plate type compressor having combined cylinder blocks closed, at both axial ends thereof, by front and rear housings, each having a radially inner suction chamber and an outer exhaust chamber isolated from the suction chamber, valve plates and disks interposed between the axial ends of the combined cylinder blocks and each of the front and rear housings, a plurality of long screw bolts axially and hermetically combining the cylinder blocks, the front and rear housings, and the valve plates and disks, and an internal sealing unit arranged in the radially inner suction chambers of the front and rear housings for rigidly holding the valve plates and disks against a high pressure of a refrigerant after compression, to reinforce the hermetic seal between the axial ends of the cylinder blocks and the valve plates and disks.

4 Claims, 4 Drawing Figures

SWASH PLATE TYPE COMPRESSOR WITH INTERNAL SEALING

BACKGROUND OF THE INVENTION

1. Field of the Invention

The present invention relates to a swash plate type compressor adapted for use in compressing a refrigerant of a vehicle air-conditioning system, and more particularly, it relates to an improved internal sealing of the swash plate type compressor.

2. Description of the Related Art

A swash plate type compressor for use in a vehicle air-conditioning system is known. A typical swash plate type compressor is disclosed in, for example, U.S. Pat. Nos. 4,070,136 and 4,403,921 to the same assignee of the present application. The typical swash plate type compressor has front and rear cylinder blocks axially combined together, front and rear housings connected to the front and rear ends of the combined cylinder blocks, via front and rear valve plates, and a rotatable drive shaft arranged so as to be axially extended through the front housing and the combined cylinder blocks, and having thereon a swash plate. The front and rear cylinder blocks, the front and rear housings, and the valve plates are axially and tightly combined together by a plurality of long screw bolts. In the swash plate type compressor, when a refrigerant returns from the air-conditioning circuit, via a return piping, it is introduced into suction chambers formed in the front and rear housings while passing through a suction port, a swash plate chamber, and inlet passageways of the combined cylinder blocks. The refrigerant is subsequently pumped into cylinder bores formed in the combined cylinder blocks while suction valves are opened in response to the reciprocation of double headed pistons within the cylinder bores. The pistons are operatively connected to the swash plate rotatable with the drive shaft, and compress the refrigerant within the cylinder bores. The compressed refrigerant is pumped from the cylinder bores into exhaust chambers formed in the front and rear housing while delivery valves are opened in response to another reciprocation of the double-headed pistons. The compressed refrigerant is subsequently delivered from the exhaust chambers toward an outlet port of the compressor, through delivery passageways and is then sent to the air-conditioning circuit. Thus, each of the front and rear housings of the compressor has a low pressure suction chamber and a high pressure exhaust chamber, respectively. At this stage, the conventional swash plate type compressor has one of two different arrangements of the suction and exhaust chambers in the housings, i.e., the suction chamber is arranged inside the exhaust chamber within the respective housing, or the suction chamber is arranged outside the exhaust chamber within the respective housing. With the former arrangement, there is an advantage such that, since a drive shaft sealing portion located adjacent to the low pressure suction chamber of the front housing need not be isolated from the suction chamber, the internal construction of the front housing can be simplified. Japanese Examined patent publication No. 56-27710 discloses a six-cylinder swash plate type compressor employing the above-mentioned former arrangement of the suction and exhaust chambers. In the compressor of this Patent publication, the suction and exhaust chambers are simply formed in inner and outer annular chambers separated from one another by a circular separation wall.

The present inventors contrived to increase the number of cylinder bores of the compressor of the Japanese Examined patent publication No. 56-27710. That is, they designed and manufactured a ten-cylinder (five at the front and five at the rear) swash plate type compressor having an internal construction similar to the compressor of this patent publication. In that case, as shown in FIG. 4, a front housing 4 was formed with a substantially pentagonal-shape inner annular suction chamber 12, and an outer annular exhaust chamber 11 isolated from the inner suction chamber 12 by a non-circular curved separation wall 13. This formation of the pentagonal suction chamber 12 is due to the necessity for arranging bosses in which five through-bores 14 are formed to enable the insertion therethrough of the long screw bolts combining the cylinder blocks and the housings, and the need for five suction apertures 15 in the valve plate to enable a suction therethrough of refrigerant from the suction chamber 12 into the five cylinder bores 10. However, the front housing 4 shown in FIG. 4 must suffer from the following defect. That is, when the refrigerant is compressed within the cylinder bores 10, a valve plate (not shown in FIG. 4) arranged between the front cylinder block and the front housing 4 is subjected to a high pressure by the compressed refrigerant, and as a result, the central portion of the valve plate, i.e., the portion facing the suction chamber 12 of the front housing which is less influenced by the clamping force of the screw bolts inserted in the through-bores 14, is forcedly deformed in a direction separating it from the front cylinder block. Further, with the central portion of the valve plate, the deformation occurring at portions remote from the separation wall 13 is larger than that occurring at the remaining portion. This is because the separation wall 13 per se effectively suppresses the deformation of the above-mentioned remaining portions of the valve plate. At this stage, since inlet passageways 18 for communicating between the suction chamber 12 and a swash plate chamber (not shown in FIG. 4) are provided in the front cylinder block so as to be located between the two neighbouring cylinder bores 10, the location of the inlet passageways 18 is very close to the above-mentioned large deformation portions of the valve plate. Therefore, when such deformation of the valve plate occurs, a breakage of the sealing occurs between the cylinder bores 10 and the inlet passageways 18. As a result, the high pressure refrigerant compressed within the cylinder bores 10 is easily and directly diverted into the inlet passageways 18 by passing through a short gap s caused by the breakage of the sealing, and heat is applied to the refrigerant prior to compression. This lowers the compression efficiency of the compressor, and accordingly, the refrigerating efficiency of the air-conditioning system.

SUMMARY OF THE INVENTION

An object of the present invention is therefore, to obviate the above-mentioned defect encountered by the conventional swash plate type compressor.

Another object of the present invention is to provide an improved internal sealing construction of a housing of a swash plate type compressor, whereby diversion of the compressed refrigerant from the cylinder bores toward a suction part of the compressor due to incomplete sealing in the housing can be prevented.

A further object of the present invention is to provide an improved internal sealing of a swash plate type compressor whereby a reduction in the compression efficiency can be prevented.

In accordance with the present invention, there is provided a swash plate type compressor having a pair of axially combined front and rear cylinder blocks forming therein a plurality of cylinder bores and a swash plate chamber; a pair of front and rear housings arranged at axial ends of the combined cylinder blocks, each housing having therein an inner suction chamber for a refrigerant to be compressed, and an outer exhaust chamber for compressed refrigerant; a separation wall arranged in each of the front and rear housings for isolating the inner suction chamber from the outer exhaust chamber; valve plates and disks interposed between the front and rear housings and the axial ends of the combined cylinder blocks; a plurality of tightening screw bolts axially and hermetically combining the front and rear housings, the valve plates and disks, and the combined cylinder blocks, together; a drive shaft extending axially through the swash plate chamber of the combined cylinder blocks; a swash plate in the swash plate chamber rotatably supported on the drive shaft; a plurality of pistons engaged with the swash plate so as to be reciprocated in the cylinder bores; a plurality of inlet passageways extending through the combined cylinder blocks and the valve plates and disks for communication between the swash plate chamber and the suction chambers of the front and rear housings, and; an internal seal unit for providing a hermetic seal between the ends of the combined cylinder blocks and the valve plates and disks. The internal seal unit is characterized by comprising a plurality of support ribs formed in the front and rear housings for rigidly holding the valve plates and disks against pressure of the compressed refrigerant within the cylinder bores of the combined cylinder blocks, thereby reinforcing the hermetic seal between the ends of the combined cylinder blocks and the valve plates and disks.

BRIEF DESCRIPTION OF THE DRAWINGS

The present invention will be made more apparent from the ensuing description of the embodiment thereof with reference to the accompanying drawings, wherein.

DESCRIPTION OF THE PREFERRED EMBODIMENTS

Figure 1:
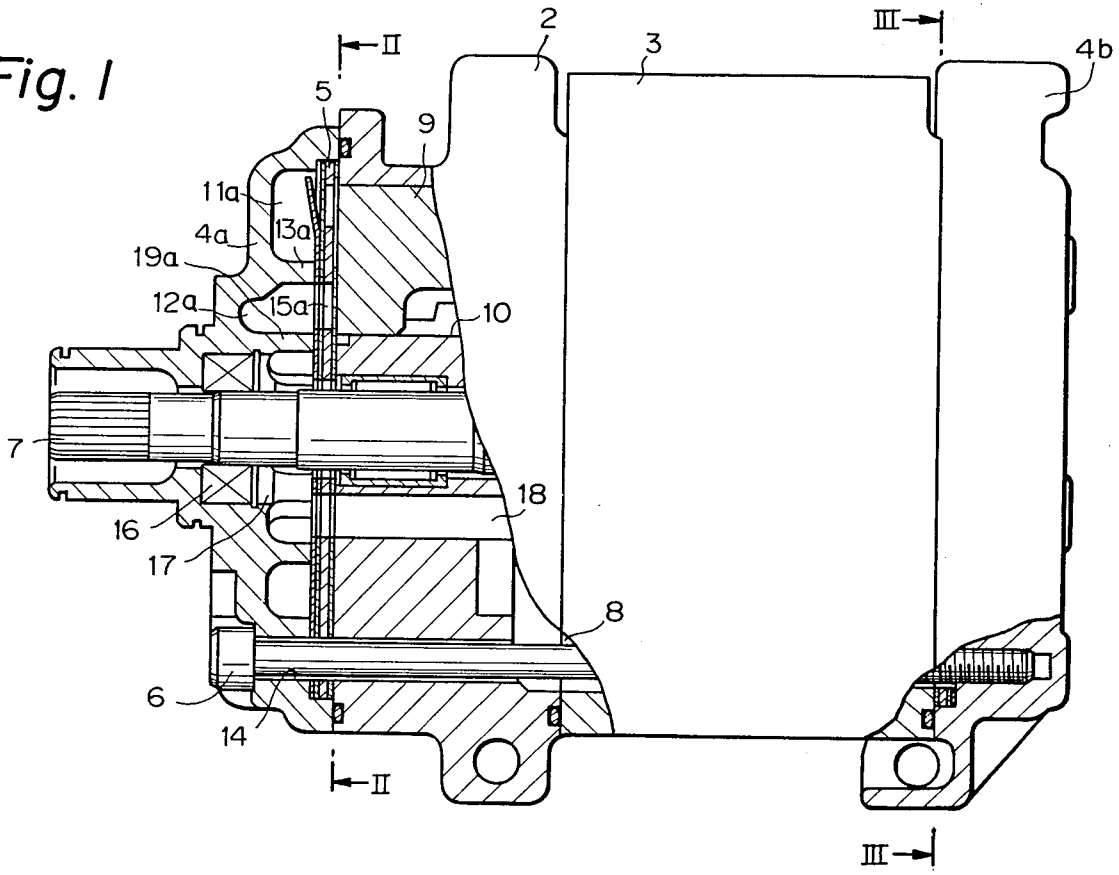
FIG. 1 is a front elevational view, in part cross-sectional, of a swash plate type compressor according to an embodiment of the present invention.
Figure 2:
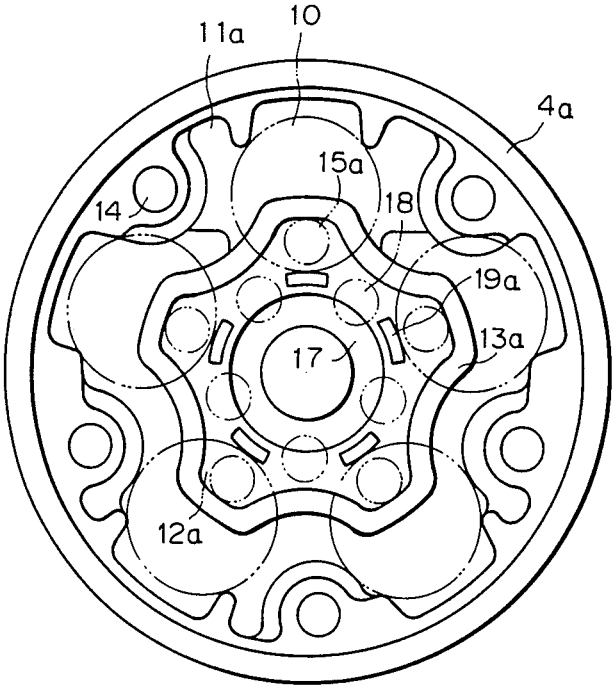
FIG. 2 is a side view of a front housing of the compressor, taken along the line II—II of FIG. 1.
Figure 3:
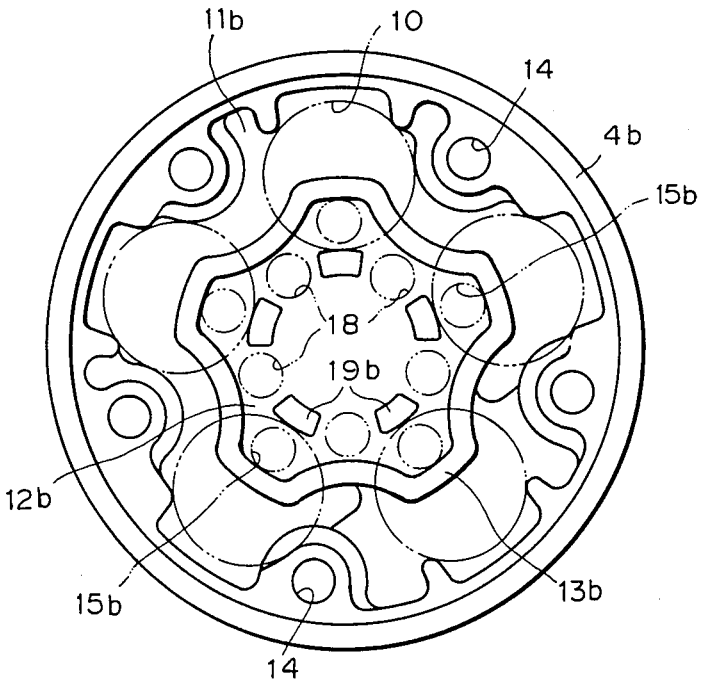
FIG. 3 is a side view of a rear housing of the compressor, taken along the line III—III of FIG. 1.

Referring to FIGS. 1 through 3, a swash plate type compressor embodying the present invention is formed as a ten-cylinder compressor having five double-headed pistons 9 axially reciprocating in five front and five rear axially aligned cylinder bores 10. The compressor has a front cylinder block 2 and a rear cylinder block 3 axially aligned and hermetically combined with one another. A front housing 4*a* and a rear housing 4*b* are positioned at both axial ends of the combined cylinder blocks 2 and 3 so as to hermetically close the ends of cylinder bores 10 of the cylinder blocks 2 and 3. Between the front and rear housings 4*a* and 4*b* and the ends of the combined cylinder blocks 2 and 3, are arranged valve plates (only a front valve plate 5 is shown in FIG. 1). Each of the valve plates, e.g., the front valve plate 5, is provided, on both sides thereof, with conventional suction and discharge valve disks which open and close in response to the reciprocation of the double-headed pistons 9. The cylinder blocks 2 and 3, the front and rear housings 4*a* and 4*b*, the front and rear valve plates, and the suction and discharge valve disks are axially combined together by a plurality of circumferentially disposed long screw bolts 6 (only one bolt 6 is shown in FIG. 1) inserted from the front to the rear of the compressor through through-bores 14. The screw bolts 6 are threadedly tightened in the rear housing 4*b*, so that the inside of the compressor is hermetically sealed away from the outside of the compressor. A drive shaft 7 is rotatably supported by rotary bearings seated in the front and rear housings 2 and 3. The drive shaft 7 supports thereon a swash plate (not shown) which is rotatable with the drive shaft 7 in a swash plate chamber 8. The swash plate is engaged with each of the pistons 9 and causes the reciprocation of the pistons 9 in the cylinder bores 10 in response to the rotation of the swash plate. The front housing 4*a* defines therein an outer exhaust chamber 11*a* and a radially inner suction chamber 12*a* isolated from the outer exhaust chamber 11*a* by a separation wall 13*a* which is shaped as an irregular pentagonal wall extending inwardly axially from the inner face of the front housing 4*a*, as best shown in FIG. 2. The adoption of the irregular pentagonal shape of the wall 13*a* is due to the necessity for arranging five boss portions having five through-holes 14 for inserting therethrough the screw bolts 6 and the need for substantially equiangularly arranging five suction apertures 15*a* in the valve plate 5 for communication between the front cylinder bores 10 and the front suction chamber 12*a*. A cylindrical sealing chamber 17 for containing a shaft seal 16 is centrally formed in the front housing 4*a* and is fluidly communicated with the suction chamber 12*a* without the intervention of a separation wall. A plurality (five in the present embodiment) of axial inlet passageways 18 are extended through the front and rear cylinder blocks 2 and 3, the front and rear valve plates, and the front and rear valve disks to establish fluid communication between the swash plate chamber 8 and the suction chamber 12*a* of the front housing 4*a* as well as the later-described suction chamber 12*b* (FIG. 3) of the rear housing 4*b*. Each of the five inlet passageways 18, which are circumferentially arranged around the center of the combined cylinder blocks 2 and 3, is disposed between two neighbouring cylinder bores 10 and is located adjacent to the inward edges of both of the two neighbouring cylinder bores 10. Also formed in the front housing 4*a* are a plurality (five in the present embodiment) of support ribs 19*a* so that each of the support ribs 19*a* is disposed between the openings of the two neighbouring inlet passageways 18, as best shown in FIG. 2. The support ribs 19*a* are integral with the front housing 4*a* and cooperate with the aforedescribed separation wall 13*a* to provide an axial rigid support for the front valve plate 5 and the associated suction and discharge valve disks against the high pressure of the refrigerant prevailing within the cylinder bores 10. At this stage, it should be understood that, as shown in FIG. 3, the rear housing 4*b* has an internal construction similar to that of the front housing 4*a* of FIG. 2 except that a sealing chamber for a shaft seal is not provided in the rear housing 4b. Thus, like elements and parts of the rear housing 4b, e.g., the exhaust chamber, the suction chamber, the separation wall, and the support ribs, are designated by the same reference numbers as those of the front housing 4a but with a suffix "b".

With the afore-described swash plate type compressor of FIGS. 1 through 3, the refrigerant returning from the outside air-conditioning circuit flows into the swash plate chamber 8 of the compressor, via an inlet port (not shown), and lubricates the swash plate and the other sliding members within the swash plate chamber 8 by a lubricant suspended in the refrigerant. The refrigerant is subsequently introduced into the suction chambers 12a and 12b of the front and rear housings 4a and 4b via the inlet passageways 18. The refrigerant is then pumped into the cylinder bores 10 of the front and rear cylinder blocks 2 and 3 when the suction valves of the front and rear valve disks are opened in the response to the reciprocation of the double-headed pistons 9 caused by the rotation of the swash plate and the drive shaft 7, and is compressed within the cylinder bores 10. The compressed refrigerant is then pumped out of the cylinder bores 10 into the exhaust chambers 11a and 11b of the front and rear housings 4a and 4b when the discharge valves of the front and rear valve disks are opened in response to another reciprocation of the pistons 9. Thereafter, the compressed refrigerant is exhausted from the exhaust chambers 11a and 11b toward the outside air-conditioning circuit by way of outlet passageways (not shown) and an outlet port (not shown).

Figure 4:
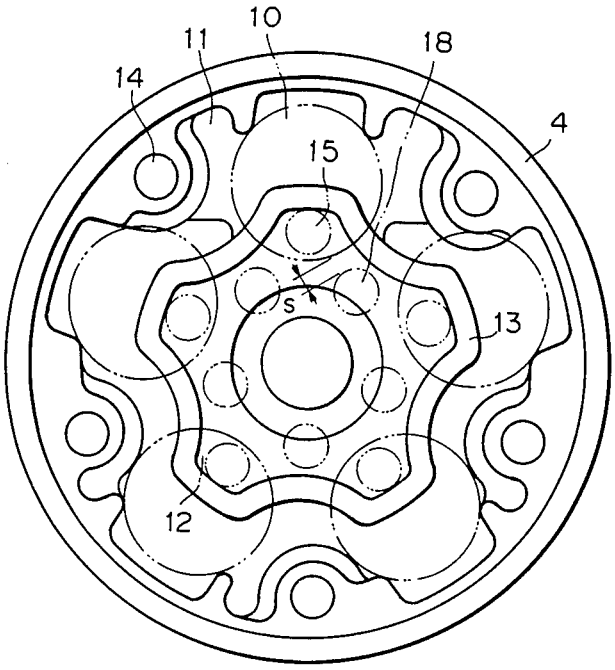
Fig. 4 (PRIOR ART)
FIG. 4 is a side view of a front housing of a compressor according to a prior art.

It should be noted that, when the refrigerant is compressed within the cylinder bores 10 due to the reciprocation of the double-headed pistons 9, the high pressure of the compressed refrigerant is applied to the valve plates and valve disks arranged adjacent to the ends of the front and rear cylinder blocks 2 and 3. As a result, portions of the valve plates and valve disks facing the suction chambers 12a and 12b and located remote from the tightening screw bolts 6, are subjected to a high pressure by the compressed refrigerant in the direction in which they are separated from the ends of the cylinder blocks 2 and 3, and as a result, these portions of the valve plates and valve disks are apt to be mechanically deformed in the axially outward direction, thus permitting breakage of the sealing between the ends of the cylinder blocks 2 and 3 and the valve plates and disks. Particularly, in the ten-cylinder swash plate type compressor of the present embodiment, since the respective inlet passageways 18 are disposed very close to the cylinder bores 10, the above-mentioned breakage of sealing causes a direct diversion of the compressed refrigerant into the inlet passageways 18 by leakage through unsealed gaps (see "s" of FIG. 4). According to the internal construction of the compressor of the present embodiment, the individual support ribs 19a and 19b of the front and rear housings 4a and 4b rigidly hold the front and rear valve plates and disks, to prevent deformation of these plates by the compressed refrigerant having a high pressure. That is, due to the provision of the respective support ribs 19a and 19b arranged at respective angular positions suited for supporting portions of the front and rear valve plates and disks between the two neighbouring inlet passageways 18, the hermetic sealing between the ends of the front and rear cylinder blocks 2 and 3 and the front and rear valve plates and disks can be reinforced. Therefore, the above-mentioned diverted flow of the compressed refrigerant can be fully prevented.

Further, since the respective support ribs 19a and 19b are formed as individual projections spaced apart from one another, the refrigerant prior to compression, within the suction chambers 12a and 12b, does not suffer from an unfavorable flow resistance.

From the foregoing description of the embodiment of the present invention, it will be understood that, according to the present invention, an improved internal sealing of a swash plate type compressor is realized. Thus, it is ensured that a lowering of the compression efficiency of the compressor as well as a lowering of the refrigerating efficiency of the air-conditioning system can be avoided.

We claim:

1. A swash plate type compressor comprising:

a pair of axially combined front and rear cylinder blocks forming therein a plurality of cylinder bores and a swash plate chamber;

a pair of front and rear housings arranged at axial ends of said combined cylinder blocks, each housing having therein an inner suction chamber for a refrigerant prior to compression and an outer exhaust chamber for a refrigerant after compression;

a separation wall arranged in each said front and rear housings for isolating said inner suction chamber from said outer exhaust chamber;

valve plates and disks interposed between said front and rear housings and said axial ends of said combined cylinder blocks;

a plurality of tightening screw bolts axially and hermetically combining said front and rear housings, said valve plates and disks, and said combined cylinder blocks together;

a drive shaft extending axially through said swash plate chamber of said combined cylinder blocks;

a swash plate in said swash plate chamber rotatably supported on said drive shaft;

a plurality of pistons engaged with said swash plate so as to be reciprocated in said cylinder bores;

a plurality of inlet passageways extending through said combined cylinder blocks and said valve plates and disks for communicating between said swash plate chamber and said suction chambers of said front and rear housings, and;

internal sealing means arranged in said front and rear housings for providing a hermetic seal between said axial ends of said combined cylinder blocks and said valve plates and disks, said internal sealing means comprising a plurality of support ribs individually formed in said front and rear housings for rigidly holding said valve plates and disks against pressure of said refrigerant after compression within said cylinder bores of said combined cylinder blocks, thereby reinforcing a hermetic seal between said axial ends of the combined cylinder blocks and said valve plates and disks.

2. A swash plate type compressor according to claim 1, wherein said support ribs are axially inward projections extending integrally from an inner face of each of said front and rear housings, said projections being circumferentially spaced apart from one another.

3. A swash plate type compressor according to claim 1, wherein said support ribs are arranged so as to rigidly hold portions of said valve plates and disks facing said inner suction chambers of said front and rear housings, and located radially remote from said plurality of tightening screw bolts.

4. A swash plate type compressor according to claim 3, wherein each of said portions of said valve plates and disks rigidly held by each of said support ribs is located close to one of said inlet passageways and one of said cylinder bores.

* * * * *